US008904972B2

(12) United States Patent
Kumar et al.

(10) Patent No.: US 8,904,972 B2
(45) Date of Patent: Dec. 9, 2014

(54) INTER-STAGE ATTEMPERATION SYSTEM AND METHOD

(75) Inventors: Rajeeva Kumar, Clifton Park, NY (US); Darrin Glen Kirchhof, Schenectady, NY (US); Gordon Raymond Smith, Ballston Spa, NY (US); William George Carberg, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 1580 days.

(21) Appl. No.: 12/240,879

(22) Filed: Sep. 29, 2008

(65) Prior Publication Data

US 2010/0077970 A1 Apr. 1, 2010

(51) Int. Cl.
*F22G 5/12* (2006.01)
*F01K 7/06* (2006.01)

(52) U.S. Cl.
CPC .... *F22G 5/12* (2013.01); *F01K 7/06* (2013.01)
USPC ..... 122/479.1; 700/288; 60/653

(58) Field of Classification Search
USPC ..... 60/653, 660, 664; 122/479.1; 700/228
See application file for complete search history.

(56) References Cited

U.S. PATENT DOCUMENTS 3,894,396 A * 7/1975 Durrant ..... 60/665
3,922,859 A * 12/1975 Durrant et al. ..... 60/665
4,578,944 A * 4/1986 Martens et al. ..... 60/39.182
4,791,889 A * 12/1988 Matsko et al. ..... 122/479.1
4,887,431 A * 12/1989 Peet ..... 60/667
RE36,524 E 1/2000 Tomlinson
6,311,647 B1 11/2001 Liebig et al.
7,028,480 B2 * 4/2006 Sekiai et al. ..... 60/646
7,668,623 B2 * 2/2010 Kephart et al. ..... 700/275
2003/0131601 A1 7/2003 Baxter
2006/0168962 A1 8/2006 Armitage et al.

FOREIGN PATENT DOCUMENTS

JP 4110507 4/1992
JP 2000266304 9/2000

* cited by examiner

*Primary Examiner* — Kang Hu
*Assistant Examiner* — John Bargero
(74) *Attorney, Agent, or Firm* — Ann M. Agosti

(57) ABSTRACT

Systems and methods for controlling exhaust steam temperatures from a finishing superheater are provided. In certain embodiments, the system includes a controller which includes control logic for predicting an exhaust temperature of steam from the finishing superheater using model-based predictive techniques (e.g., based on empirical data or thermodynamic calculations). Based on the predicted exhaust temperature of steam, the control logic may use feed-forward control techniques to control the operation of an inter-stage attemperation system upstream of the finishing superheater. The control logic may determine if attemperation is required based on whether the predicted exhaust temperature of steam from the finishing superheater exceeds a set point temperature as well as whether the inlet temperature of steam into the finishing superheater drops below a set point temperature of steam. The attemperation system may include a characterizing function to linearize the valve operation controlled by the control logic to inject cooled, high-pressure feedwater into the steam upstream of the finishing superheater, which may, in turn, control the exhaust temperature of steam from the finishing superheater. The disclosed embodiments may also be applied to any systems where an outlet temperature of a fluid from a heat transfer device may be controlled.

15 Claims, 6 Drawing Sheets

INTER-STAGE ATTEMPERATION SYSTEM AND METHOD

BACKGROUND OF THE INVENTION

The present invention relates generally to model-based predictive control of temperatures. More specifically, the invention relates to model-based predictive temperature control of steam in relation to inter-stage attemperation, which may be used in heat recovery steam generation (HRSG) systems in combined cycle power generation applications.

HRSG systems may produce steam with very high exhaust temperatures. In particular, HRSG systems may include superheaters through which steam may be superheated before being used by a steam turbine. If the exhaust steam from the superheaters reaches high enough temperatures, the steam turbine, as well as other equipment downstream of the HRSG, may be adversely affected. For instance, high cyclic thermal stress in the steam piping and steam turbine may eventually lead to shortened life cycles. Conventional control systems have been devised to help monitor and control the temperature of exhaust steam from HRSG systems. Unfortunately, these control systems often allow temperature overshoot during transient periods where, for instance, inlet temperatures into the superheaters increase rapidly. In addition, these control systems often require a great deal of tuning and re-tuning.

BRIEF DESCRIPTION OF THE INVENTION

Systems and methods for controlling exhaust steam temperatures from a finishing superheater are provided. In certain embodiments, the system includes a controller which includes control logic for predicting an exhaust temperature of steam from the finishing superheater using model-based predictive techniques (e.g., based on thermodynamic calculations). Based on the predicted exhaust temperature of steam, the control logic may use feed-forward control techniques to control the operation of an inter-stage attemperation system upstream of the finishing superheater. The control logic may determine if attemperation is desired based on whether the predicted exhaust temperature of steam from the finishing superheater exceeds a set point temperature as well as whether the inlet temperature of steam into the finishing superheater drops below a set point temperature of steam. The attemperation system may include a characterizing function to linearize the valve operation controlled by the control logic to inject cooled, high-pressure feedwater into the steam upstream of the finishing superheater, which may, in turn, control the exhaust temperature of steam from the finishing superheater. The disclosed embodiments may also be applied to any systems where an outlet temperature of a fluid from a heat transfer device may be controlled.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters are not exclusive of other parameters of the disclosed embodiments.

As discussed in detail below, temperature control systems may be employed which are configured to predict the exhaust temperature of steam from a finishing superheater using model-based predictive techniques. In the disclosed embodiments, the temperature control systems may use the predicted value for exhaust temperature in conjunction with feed-forward control to control the operation of an inter-stage attemperation system upstream of the finishing superheater, thereby controlling the exhaust temperature from the finishing superheater. In particular, embodiments of the model-based predictive temperature control may determine if attemperation is desired based on whether the predicted exhaust temperature of steam from the finishing superheater exceeds a set point temperature as well as whether the inlet temperature of steam into the finishing superheater approaches or is less than the saturation temperature of steam.

Figure 1:
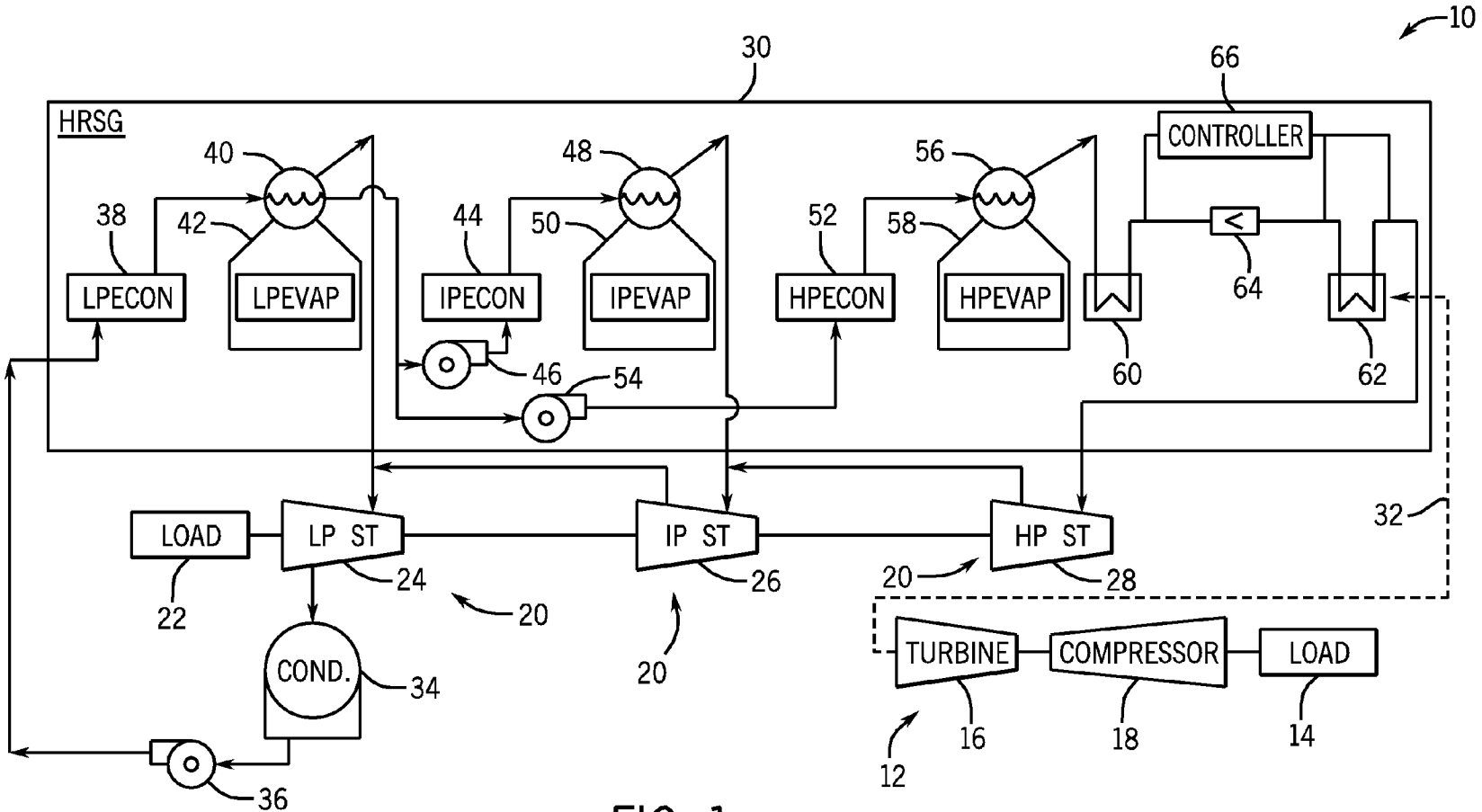
FIG. 1 is a schematic flow diagram of an embodiment of a combined cycle power generation system having model-based predictive temperature control.

FIG. 1 is a schematic flow diagram of an embodiment of a combined cycle power generation system 10 having model-based predictive temperature control, as discussed in detail below. The system 10 may include a gas turbine 12 for driving a first load 14. The first load 14 may, for instance, be an electrical generator for producing electrical power. The gas turbine 12 may include a turbine 16 and a compressor 18. The system 10 may also include a steam turbine 20 for driving a second load 22. The second load 22 may also be an electrical generator for generating electrical power. However, both the first 14 and second 22 loads may be other types of loads capable of being driven by the gas turbine 12 and steam turbine 20. In addition, although the gas turbine 12 and steam turbine 20 may drive separate loads 14 and 22, as shown in the illustrated embodiment, the gas turbine 12 and steam turbine 20 may also be utilized in tandem to drive a single load via a single shaft. In the illustrated embodiment, the steam turbine 20 may include one low-pressure stage 24, one intermediate-pressure stage 26, and one high-pressure stage 28. However, the specific configuration of the steam turbine 20, as well as the gas turbine 12, may be implementation-specific and may include any combination of stages.

The system 10 may also include a multi-stage heat recovery steam generator (HRSG) 30. The components of the HRSG 30 in the illustrated embodiment are a simplified depiction of the HRSG 30 and are not intended to be limiting. Rather, the illustrated HRSG 30 is shown to convey the general operation of such HRSG systems. Heated exhaust gas 32 from the gas turbine 12 may be transported into the HRSG 30 and used to heat steam used to power the steam turbine 20. Exhaust from the low-pressure stage 24 of the steam turbine 20 may be directed into a condenser 34. Condensate from the condenser 34 may, in turn, be directed into a low-pressure section of the HRSG 30 with the aid of a condensate pump 36.

The condensate may then flow through a low-pressure economizer 38 (LPECON), which may be used to heat the condensate. From the low-pressure economizer 38, the condensate may be directed into a low-pressure drum 40. From the low-pressure drum 40, the condensate may be drawn into a low-pressure evaporator 42 (LPEVAP), which may return steam to the low-pressure drum 40. The steam from the low-pressure drum 40 may be sent to the low-pressure stage 24 of the steam turbine 20. Condensate from the low-pressure drum 40 may be pumped into an intermediate-pressure economizer 44 (IPECON) by an intermediate-pressure boiler feed pump 46. From the intermediate-pressure economizer 44, the condensate may be directed into an intermediate-pressure drum 48. From the intermediate-pressure drum 48, the condensate may be drawn into an intermediate-pressure evaporator 50 (IPEVAP), which may return steam to the intermediate-pressure drum 48. The steam from the intermediate-pressure drum 48 may be sent to the intermediate-pressure stage 26 of the steam turbine 20. Condensate from the low-pressure drum 40 may also be pumped into a high-pressure economizer 52 (HPECON) by a high-pressure boiler feed pump 54. Again, the connections between the economizers, evaporators, and the steam turbine may vary across implementations as the illustrated embodiment is merely illustrative of the general operation of an HRSG system.

Finally, condensate from the high-pressure economizer 52 may be directed into a high-pressure drum 56. From the high-pressure drum 56, the condensate may be drawn into a high-pressure evaporator 58 (HPEVAP), which may return steam to the high-pressure drum 56. Steam exiting the high-pressure drum 56 may be directed into a primary high-pressure superheater 60 and a finishing high-pressure superheater 62, where the steam is superheated and eventually sent to the high-pressure stage 28 of the steam turbine 20. Exhaust from the high-pressure stage 28 of the steam turbine 20 may, in turn, be directed into the intermediate-pressure stage 26 of the steam turbine 20, and exhaust from the intermediate-pressure stage 26 of the steam turbine may be directed into the low-pressure stage 24 of the steam turbine 20. In certain embodiments, a primary and secondary re-heater may also be used with the primary high-pressure superheater 60 and the finishing high-pressure superheater 62.

As mentioned above, embodiments of inter-stage attemperation may be used in conjunction with HRSG systems applied in combined cycle power generation applications as illustrated in FIG. 1. However, embodiments of inter-stage attemperation may also be used in other boiler systems where temperature-controlled steam may be desirable. In combined cycle systems such as system 10, hot exhaust may flow from the gas turbine 12 and pass through HRSG 30 and may be used to generate high-pressure, high temperature steam. The steam produced by the HRSG 30 may then be passed through the steam turbine 20 for power generation. In addition, the produced steam may also be supplied to any other processes where steam may be used.

In HRSG systems, it may be desirable to maintain a predetermined design steam temperature, generated by the HRSG 30, to maintain the efficiency of the processes and the life of the steam turbine 20 and associated equipment. In the event of excessive steam temperatures, beyond the control of the inter-stage attemperation system, the gas turbine 12 exhaust temperature into the HRSG 30 may be reduced to avoid high stress in the downstream steam turbine 20 and associated equipment. In some cases, due to excessive temperatures, control measures may trip (i.e., temporarily cause to be bypassed or otherwise cease operation) the gas turbine 12 and/or steam turbine 20. This may result in a loss of power generation which may, in turn, impair plant revenues and operability. Inadequately controlled steam temperatures may also lead to high cyclic thermal stress in the steam piping and steam turbine 20, affecting their useful life.

However, superheater and re-heater inter-stage attemperation may be used to achieve robust temperature control of the steam leaving the HRSG 30. An inter-stage attemperator 64 may be located in between the primary high-pressure superheater 60 and the finishing high-pressure superheater 62. The inter-stage attemperator 64 enables more robust control of the exhaust temperature of steam from the finishing high-pressure superheater 62. An inter-stage attemperator controller 66 may include controller logic for more precisely controlling the steam exhaust temperature from the finishing high-pressure superheater 62. Again, although not illustrated in FIG. 1, a primary and/or secondary re-heater may also either be associated with dedicated attemperation equipment or utilize the inter-stage attemperator 64 for attemperation of exhaust steam temperatures from the re-heaters.

Figure 2:
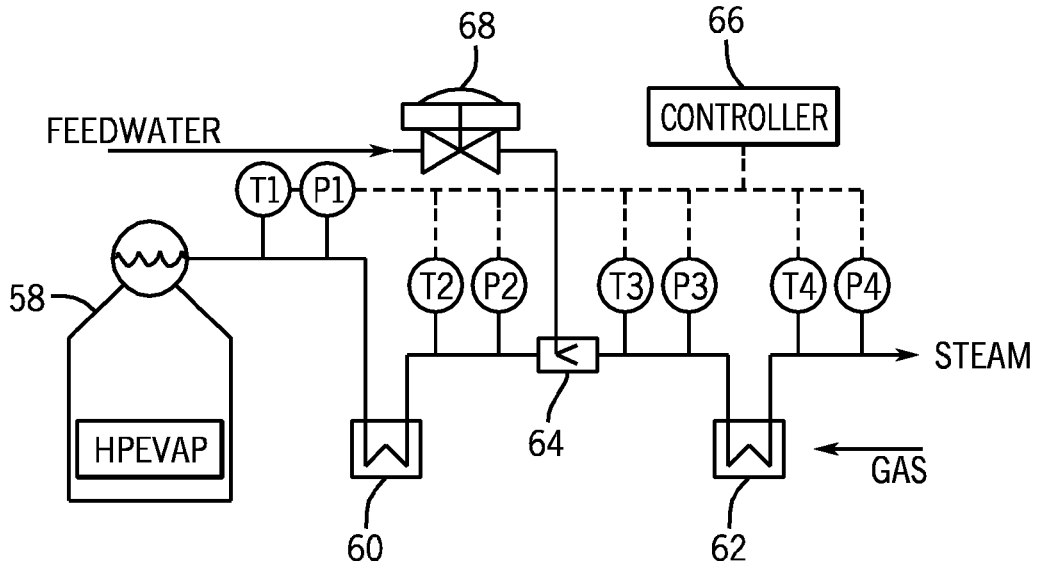
FIG. 2 is a schematic flow diagram of an embodiment of an inter-stage attemperation system of the system of FIG. 1.

FIG. 2 is a schematic flow diagram of an embodiment of an inter-stage attemperation system of the system 10 of FIG. 1. The inter-stage attemperator 64 may, for instance, control the temperature of steam by enabling cooler, high-pressure feedwater, such as a feedwater spray, through a control valve 68 when appropriate. The control valve 68 may be any appropriate type of valve. However, no matter what type of valve is used, operation of the control valve 68 may be influenced by controller logic within the inter-stage attemperator controller 66. Inputs into the controller logic of the inter-stage attemperator controller 66 may, for instance, include the temperature $T_1$ and pressure $P_1$ of steam entering the primary high-pressure superheater 60, the temperature $T_2$ and pressure $P_2$ of steam exiting the primary high-pressure superheater 60, the temperature $T_3$ and pressure $P_3$ of steam entering the finishing high-pressure superheater 62, and the temperature $T_4$ and pressure $P_4$ of steam exiting the finishing high-pressure superheater 62.

Figure 3:
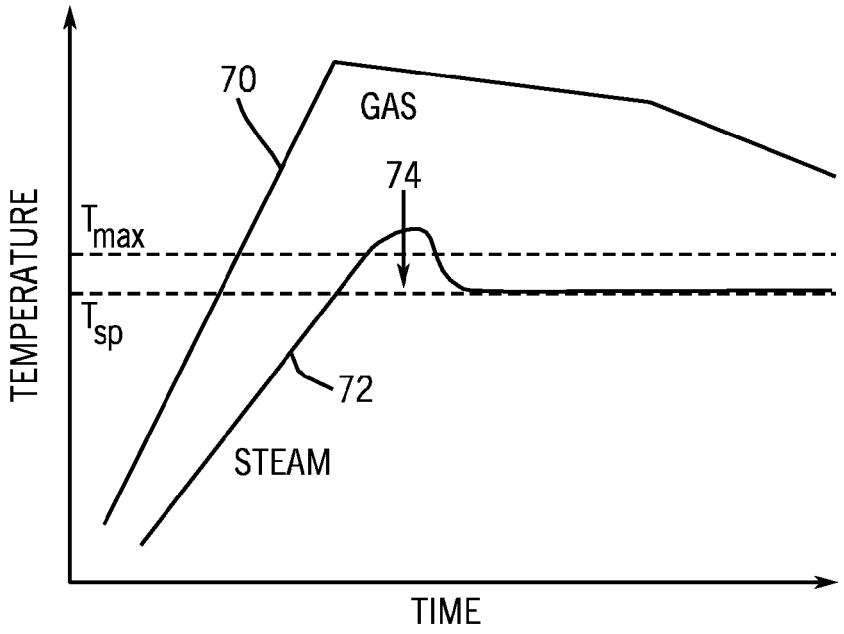
FIG. 3 is a graph illustrating an overshoot problem associated with non-model-based inter-stage attemperator controller logic.

As discussed below, embodiments of the attemperator control logic may include a model-based predictive temperature control scheme to overcome drawbacks of other techniques. Thus, a short discussion of another technique will precede a detailed discussion of the model-based techniques. In particular, a non-model-based technique (i.e., to be replaced with a model-based technique) may consist of a control structure where an outer loop creates a set point temperature $T_3$ for steam entering the finishing high-pressure superheater 62 based on a difference between a desired and actual steam temperature $T_4$ exiting the finishing high-pressure superheater 62. An outer loop proportional-integral-derivative (PID) controller may establish the set point temperature for an inner loop PID controller. The inner loop of the control logic may drive the control valve 68 based on the difference between the actual and set point temperature to suitably reduce the steam temperature $T_3$ before it enters the finishing high-pressure superheater 62. Unfortunately, this non-model-based technique may not always work to control steam temperature overshoots during transient changes in the gas turbine 12 output, as shown in FIG. 3. In addition, this non-model-based technique may often require a great deal of tuning.

Regarding the overshoot problem with the non-model-based technique as illustrated in FIG. 3, as the temperature of the exhaust gas, illustrated by line 70, from the gas turbine 12 increases, the temperature $T_4$ of the steam exiting the finishing high-pressure superheater 62, illustrated by line 72, may not only increase beyond the set point temperature $T_{sp}$, but may continue to overshoot a maximum allowable temperature $T_{max}$ even after the temperature of the exhaust gas begins to decrease. This overshoot problem may be due in part to presence of significant thermal lag caused by the mass of metal used in the finishing high-pressure superheater 62. Other factors affecting attemperation may include the type and sizing of attemperation valves, operating conditions of the feedwater pump, distances between equipment used, other limitations of equipment used, sensor location and accuracy, and so forth. This overshoot problem may also become more acute when the gas turbine 12 exhaust temperature changes rapidly.

In general, the exhaust temperature overshoot problem may be more pronounced as the gas temperature approaches an isotherm (corner point). This condition may be characterized by low steam flow and higher gas temperature. For a fixed gas turbine operation, the exhaust temperature overshoot depends not only on the controller logic but also on the temperature set point profile. In the non-model-based technique, this temperature set point may be chosen such that the attemperation control valve 68 may open even before the steam reaches the required design temperature. Then, the attemperation control valve 68 may be ramped up to the specified design value to avoid overshoot at the corner point. Insisting on a temperature set point profile where the set point reaches the design steam temperature before the gas temperature reaches the isotherm represents an aggressive schedule and may likely lead to the exhaust temperature overshoot problem. Conversely, as discussed below, embodiments of model-based predictive temperature control may use the gas temperature information to design the temperature set point profile such that the design steam temperature may be reached at or after the gas temperature reaches the isotherm. Such temperature set point profile may therefore result in fewer temperature overshoots. As illustrated by arrow 74, the disclosed model-based predictive temperature control may reduce or eliminate the overshoot problem discussed above in association with the non-model-based technique.

In order to protect the steam turbine 20 and associated piping, valving, and other equipment, certain control design parameters may be imposed on the performance of the controller logic of the inter-stage attemperator controller 66. For instance, one design parameter may be to maintain the exhaust steam temperature $T_4$ at the set point temperature $T_{sp}$ (e.g., 1050° F.) whenever possible. However, whenever the exhaust steam temperature $T_4$ overshoots the set point temperature $T_{sp}$, certain "swing clause" values may be used to determine allowable average temperature $T_{avg}$ values which may be allowed for the exhaust steam temperature $T_4$. For instance, $T_{avg}$ may not be allowed to stay above the set point temperature $T_{sp}$ plus 15° F. continuously. In addition, $T_{avg}$ may not be allowed to stay above the set point temperature $T_{sp}$ plus 25° F. for more than 400 hours over a 12-month period. Furthermore, $T_{avg}$ may not be allowed to stay above the set point temperature $T_{sp}$ plus 50° F. for more than 80 hours over a 12-month period and also may not be allowed to stay above the set point temperature $T_{sp}$ plus 50° F. for 15 minutes in a row. These "swing clause" values are merely illustrative and are not intended to be limiting. They are merely shown to illustrate the type of control design constraints which may be used by the controller logic of the inter-stage attemperator controller 66. Other control design constraints on the controller logic may include physical limitations such as allowing feedwater spray to be introduced by the control valve 68 only when the spray may be vaporized and absorbed into the steam flow.

Figure 4:
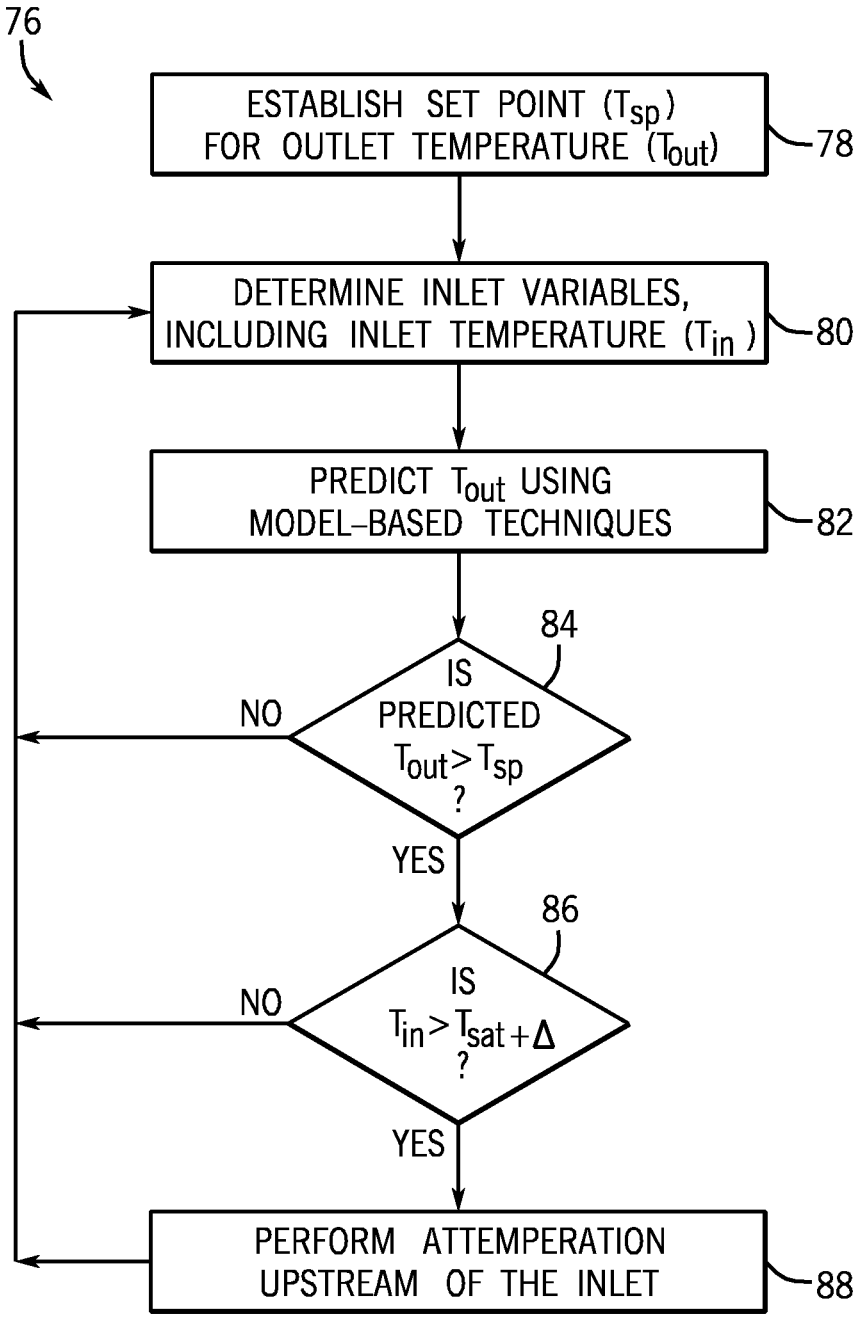
FIG. 4 is a flow diagram of an embodiment of a model-based predictive temperature control method for controlling exhaust steam temperatures in the system of FIG. 1.

FIG. 4 is a flow diagram of an embodiment of a model-based predictive temperature control method 76 for controlling exhaust steam temperatures in the system 10 of FIG. 1. The method 76 is presented in the context of controlling the exhaust temperature from the finishing high-pressure superheater 62 of the HRSG 30 described above with respect to FIGS. 1 and 2. However, the method 76 may also be applied to many different types of processes where the outlet temperature of a fluid from a heat transfer device may be controlled. At step 78, a set point temperature $T_{sp}$ may be set for the outlet temperature $T_{out}$ of steam from the finishing high-pressure superheater 62. As described above, the set point temperature $T_{sp}$ may be set to any particular temperature which may protect the steam turbine 20 and associated piping, valving, and other equipment. In other embodiments, the set point temperature $T_{sp}$ may represent a percentage or offset value of the maximum allowable temperature $T_{max}$. A suitable value for the set point temperature $T_{sp}$ may, for instance, be 1050° F.

At step 80, relevant inlet variables into the finishing high-pressure superheater 62, including the inlet temperature $T_{in}$ of steam, may be determined. These variables may also include, but are not limited to, the inlet temperature of gas, the inlet pressure of steam and gas, the inlet flow rate of steam and gas, the steam specific heat, the equivalent heat transfer coefficient, the equivalent heat transfer area, and so forth. These variables may be used in step 82 to predict the outlet temperature $T_{out}$ of steam from the finishing high-pressure superheater 62 using model-based predictive techniques, as described in greater detail below. The model-based techniques may include various methods for predicting the outlet temperature $T_{out}$ of steam. For instance, one method for creating a prediction model may be to use past performance data regarding the finishing high-pressure superheater 62 to correlate how the outlet temperature $T_{out}$ of steam from the finishing high-pressure superheater 62 changes based on empirical inlet data variables (e.g., using data-driven input/output maps). Another method may be to employ thermodynamic principles to create a prediction model based on mathematical equations which may approximate how the finishing high-pressure superheater 62 actually functions as a heat transfer device.

The disclosed embodiments employ model-based predictive techniques with a feed-forward controller loop in parallel with a proportional-integral (PI) controller loop. In particular, whereas non-model-based PID controllers may allow for control based only on actual data prior to the control time period, the model-based techniques enable forward-looking prediction of what the expected outlet temperature $T_{out}$ temperature from the finishing high-pressure superheater 62 may be based on inlet conditions during the control time period. The predicted value of outlet temperature $T_{out}$ may be used with a feed-forward controller loop in parallel with a PI controller loop to more precisely determine an adjusted set point temperature $T_{sp}$ value for an inner loop, which may actually be responsible for controlling the attemperation process. The PI in the outer loop may be used to compensate for differences which may exist between measured values and the predicted model values due to the fact that the predictive model may inherently differ slightly from the reality of the physical system. Therefore, control logic using the disclosed embodiments may allow for a more robust, forward-looking control structure for the attemperation process.

In general, the method 76 may include two separate decision steps regarding whether the attemperation process should be performed. For instance, at step 84, a determination may be made of whether the outlet temperature $T_{out}$ predicted by the model-based techniques is greater than the set point temperature $T_{sp}$ established in step 78. If the predicted outlet temperature $T_{out}$ is greater than the set point temperature $T_{sp}$, then attemperation may be warranted and the method 76 may continue to the second decision at step 86. Otherwise, attemperation may be unnecessary for the current time period and the method 76 may proceed back to step 80 to re-evaluate the situation for a subsequent time period.

In other words, the predictive model is configured to provide a feed-forward signal capable of setting the set point for a controller in the loop. However, a feed-back signal from the finishing high-pressure superheater 62 outlet temperature may provide the final trimming of the outlet temperature. The predictive model-based control approximates the spray flow to the needed value rapidly while the temperature trimming provides small adjustments to remove any inaccuracies in the predictive model.

At step 86, a determination may be made of whether the inlet temperature $T_{in}$ into the finishing high-pressure superheater 62 is greater than the saturation temperature $T_{sat}$ of steam plus some pre-determined safety value Δ. This step may be desirable to ensure that the steam stays well above the saturation temperature $T_{sat}$ of steam. This determination may be made using steam tables and the inlet pressure $P_{in}$ of the steam. If the inlet temperature $T_{in}$ of steam is greater than $T_{sat}+\Delta$, then attemperation may be warranted and the method 76 may continue to step 88. However, if the inlet temperature $T_{in}$ of steam is already currently less than $T_{sat}+\Delta$, then attemperation may be bypassed and the method 76 may proceed back to step 80 to re-evaluate the situation for a subsequent time period. This control step is essentially an override of the spray attemperation to prevent water impingement on the tubes of the finishing high-pressure superheater 62, which would result in higher than normal stresses in the tubes.

Therefore, even if it is determined in step 84 that attemperation may be desirable in order to keep the outlet temperature $T_{out}$ of steam under the set point temperature $T_{sp}$, attemperation may be bypassed in order to maintain the steam temperature sufficiently above the saturation point. In other words, the outlet temperature $T_{out}$ of steam may be allowed to temporarily rise above the set point temperature $T_{sp}$. From a control standpoint, the decision between proceeding with attemperation because the predicted outlet temperature $T_{out}$ of steam is greater than the set point temperature $T_{sp}$ and not proceeding because the inlet temperature $T_{in}$ of steam is not greater than $T_{sat}+\Delta$ may be implemented using an override controller. It should be noted that the decisions shown in steps 84 and 86 may be somewhat simplified compared to actual control logic which may be implemented. However, steps 84 and 86 are merely meant to be illustrative of the type of multiple-part decision which may be implemented in controlling exhaust steam temperatures using the disclosed embodiments of model-based predictive temperature control.

Finally, at step 88, the process of attemperation may be performed upstream of the inlet into the finishing high-pressure superheater 62 in order to reduce the inlet temperature $T_{in}$ of steam such that the outlet temperature $T_{out}$ of steam may likewise be reduced. As discussed above with respect to FIG. 2, the attemperation may involve opening the control valve 68 to allow cooled, high-pressure feedwater spray to be introduced into the steam flow. The spray may act to cool the steam flow such that the inlet temperature $T_{in}$ into the finishing high-pressure superheater 62 may be reduced.

Using the disclosed embodiments of model-based temperature control, a linearization function block may be provided in the control loop to make the loop gain fairly constant. This approach may allow for simplified tuning (e.g., requiring tuning only at one load) and consistent loop response over the load range. Linearization of the control valve response in this manner may also prove particularly useful when operating a large plant with heavy equipment since it may be difficult to gain access to the equipment in order to check the tuning of the loops.

Therefore, an advantageous component of the method 76 for controlling exhaust steam temperatures illustrated in FIG. 4 may be the prediction of the outlet temperature $T_{out}$ of steam using model-based techniques (i.e. step 82 of method 76). As discussed above, the particular model used may be any appropriate model and may be created using, for instance, empirical methods based upon correlations of past performance data as well as mathematical calculations based upon thermodynamic principles of the system.

Figure 5:
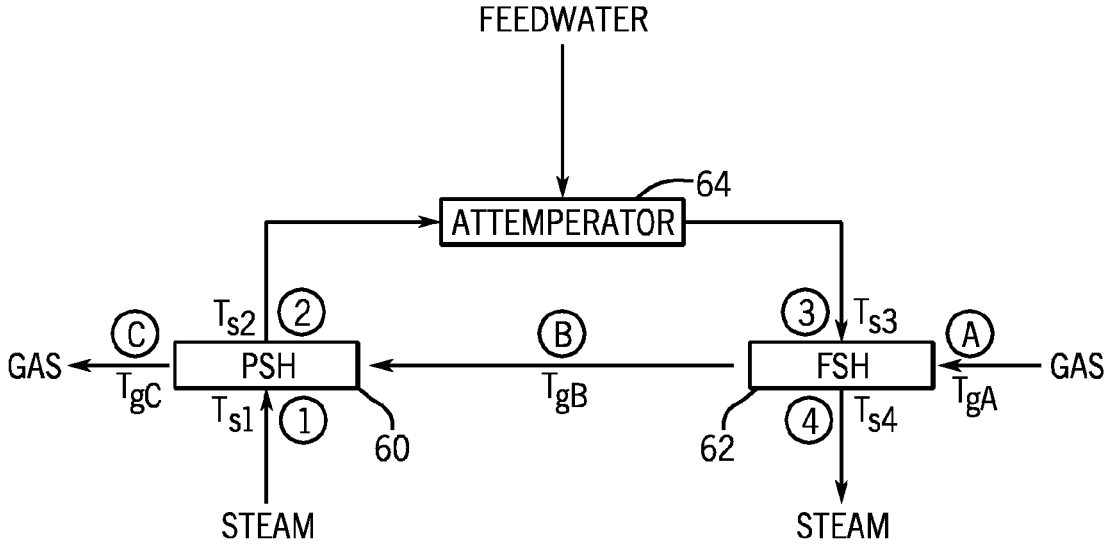
FIG. 5 is an embodiment of a thermodynamic model which may be used in the model-based predictive temperature control method of FIG. 4 for controlling exhaust steam temperatures.

FIG. 5 is an embodiment of a thermodynamic model which may be used in the model-based predictive temperature control method 76 of FIG. 4 for controlling exhaust steam temperatures. As discussed above with respect to FIG. 2, steam may enter the primary high-pressure superheater 60 (PSH) at a temperature of $T_{s1}$, exit the primary high-pressure superheater 60 at a temperature of $T_{s2}$, enter and exit the inter-stage attemperator 64, enter the finishing high-pressure superheater 62 (FSH) at temperature of $T_{s3}$, and exit the finishing high-pressure superheater 62 at a temperature of $T_{s4}$. In addition, gas may enter the finishing high-pressure superheater 62 at a temperature of $T_{gA}$, exit the finishing high-pressure superheater 62 and enter the primary high-pressure superheater 60 at a temperature of $T_{gB}$, and exit the primary high-pressure superheater 60 at a temperature of $T_{gC}$. The disclosed embodiments may utilize a steady state first principle of thermodynamics model of the form:

$$T_{s4} = T_{gA} - (T_{gA} - T_{s3})e^{-\left(\frac{U_e A_e}{W_s C_{ps}}\right)}$$

where $U_e$ is the equivalent heat transfer coefficient across the finishing high-pressure superheater 62, $A_e$ is the equivalent heat transfer area across the finishing high-pressure superheater 62, $W_s$ is the steam flow rate, and $C_{ps}$ is the steam specific heat. Therefore, in general, this steady state first principle model may only take into account variables at the finishing high-pressure superheater 62 to predict the exhaust temperature $T_{s4}$ of steam from the finishing high-pressure superheater 62.

In contrast, in another embodiment, a second equation may be employed which uses the primary high-pressure superheater 60 as a surrogate. This surrogate model may be of the form:

$$T_{s4} = T_{gA} - (T_{gA} - T_{s3})\left(\frac{T_{gC} - T_{s2}}{T_{gC} - T_{s1}}\right)e^{-\left(\frac{A_e}{W_s C_{ps}}\right)_{FHPSH}\left(\frac{W_s C_{ps}}{A_e}\right)_{PHPSH}}$$

where PHPSH stands for primary high-pressure superheater 60 and FHPSH stands for finishing high-pressure superheater 62. Both of these models may function adequately for controlling the exhaust steam temperature. In addition, various other appropriate models (e.g. transient, as opposed to steady state, models) may be envisioned and utilized as these two models are merely illustrative. However, the steady state first principle model may prove better suited for use with the feed-forward controller design of the disclosed embodiments. Similar modeling may be utilized in the event that a primary and/or secondary re-heater (not shown) are used in conjunction with the inter-stage attemperator 64. Furthermore, similar modeling may also be utilized in the event that a secondary superheater is used in conjunction with the primary and finishing superheaters.

Figure 6:
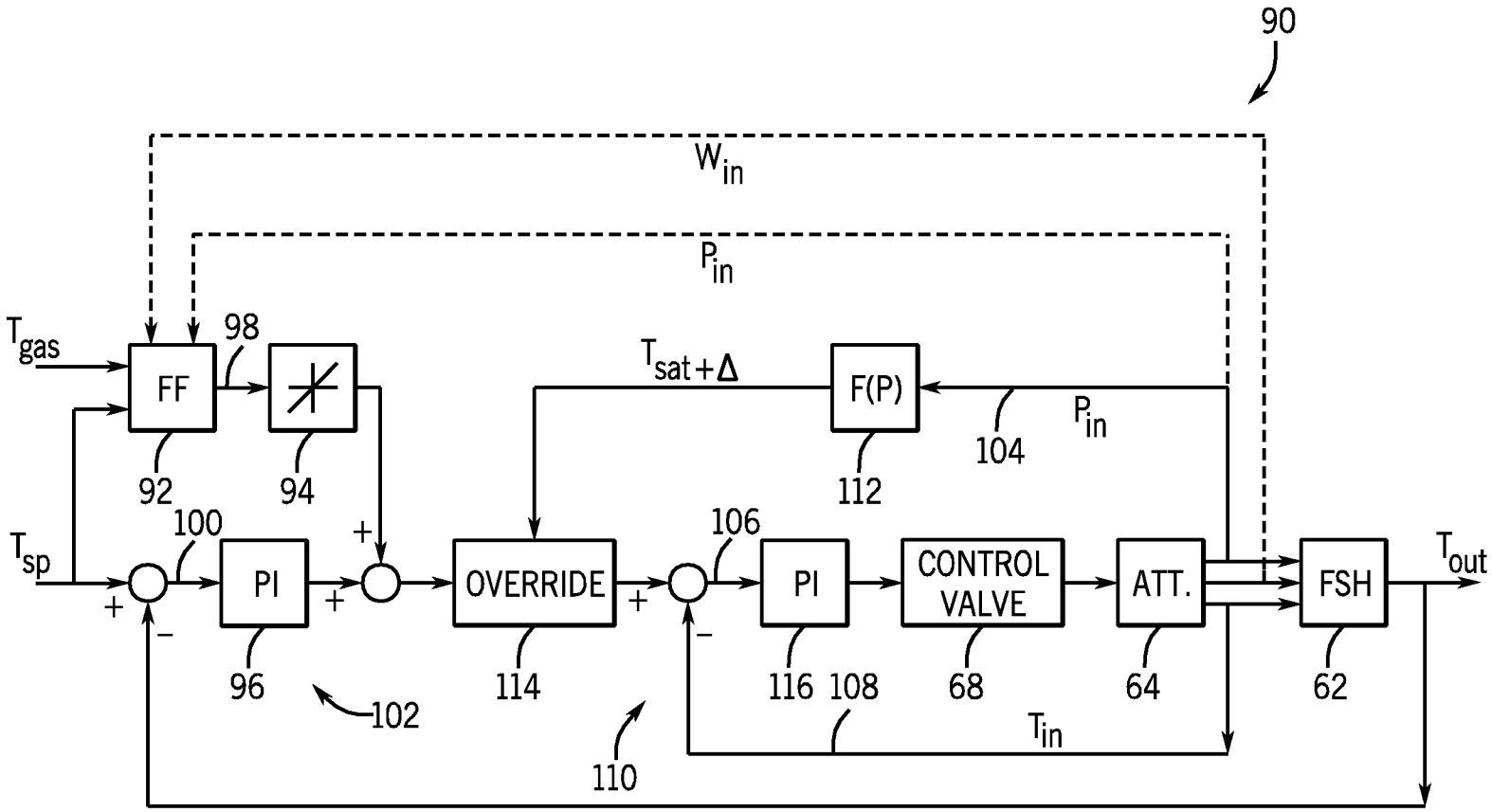
FIG. 6 is an embodiment of a controller structure having model-based predictive temperature control.

FIG. 6 is an embodiment of a controller structure 90 having model-based predictive temperature control. As illustrated, a feed-forward controller 92 may use the value for the predicted outlet temperature $T_{out}$ of steam after the value has been determined taking into account, among other things, the inlet temperature of gas $T_{gas}$, the set point temperature $T_{sp}$ for exhaust steam from the finishing high-pressure superheater 62, and the inlet temperature $T_{in}$, inlet pressure $P_{in}$, and inlet flow rate $W_{in}$ of steam into the finishing high-pressure superheater 62. As discussed above with respect to FIG. 5, the feed-forward value may be determined using model-based predictive techniques, such as a steady state first principle thermodynamic model. The determined feed-forward value may be tempered by a rate limiter 94 which may limit the rate of change to ensure that any sudden changes in the predicted outlet temperature $T_{out}$ of steam may not lead to undesired transient distortions. An outer loop PI controller 96 used in parallel with the feed-forward controller 92 loop may help compensate for any differences between the predictive model and real-world reactions.

These parallel control paths 98, 100 may be referred to as an outer loop 102 while the other three illustrated parallel paths 104, 106, 108 may be referred to as an inner loop 110. However, the exact control elements and control paths may vary among implementations as the illustrated control elements and paths are merely intended to be illustrative of the disclosed embodiments. For example, in certain embodiments, the feed-forward controller 92 and outer loop PI controller 96 may be replaced by a single model predictive control algorithm. In addition, in other embodiments, the cascading structure of the outer loop 102 and the inner loop 110 may be replaced by a single model predictive controller which may directly manipulate the control valve 68 and inter-stage attemperator 64.

As discussed above with respect to FIG. 4, the saturation temperature $T_{sat}$ of steam into the finishing high-pressure superheater 62 may be calculated based upon, among other things, the inlet pressure $P_{in}$ of steam flowing into the finishing high-pressure superheater 62. This calculation may be made based on some function 112 of pressure, for instance, via steam tables. Once the saturation temperature $T_{sat}$ of steam into the finishing high-pressure superheater 62 is calculated, this value plus some safety value Δ may be used by an override controller 114. If the inlet temperature $T_{in}$ is already below $T_{sat}+\Delta$, the adjusted set point temperature for the inner loop 110 may be overridden by the override controller 114. From the override controller 114, the inner loop PI controller 116 may operate to manipulate the control valve 68 to either increase or decrease the amount of attemperation at the inter-stage attemperator 64 which, in turn, may affect the inlet temperature $T_{in}$ of steam at the inlet of the finishing high-pressure superheater 62. As discussed above with respect to FIG. 4, the control valve 68 may be accompanied with a linearization function block to make the loop gain generally constant.

Figure 7:
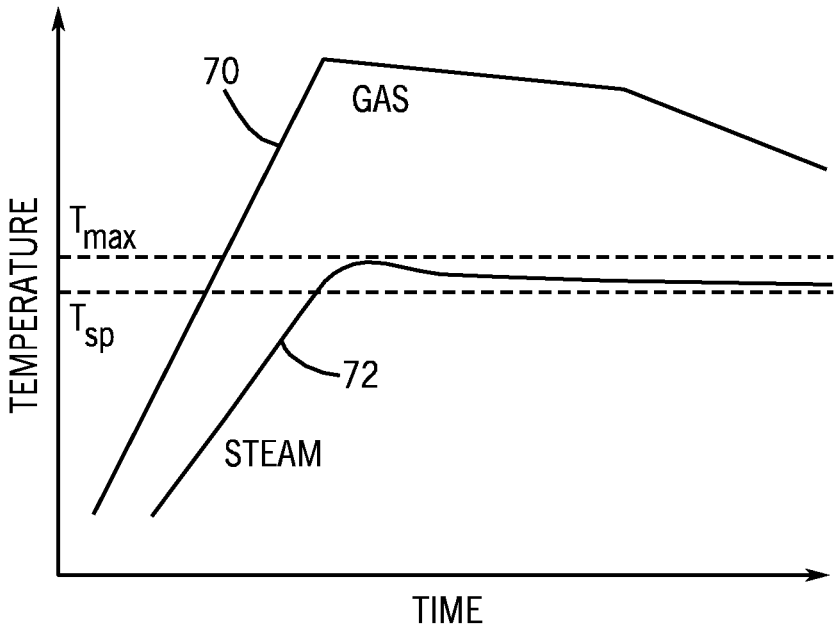
FIG. 7 is a graph illustrating reduction of the overshoot problem shown in FIG. 3 in accordance with embodiments of model-based predictive temperature control.

As shown in FIG. 7, using the disclosed embodiments of model-based predictive feed-forward control, the overshoot problem illustrated in FIG. 3 may largely be remedied. It should be mentioned that if the set point for the exhaust temperature is established more "aggressively," it has been observed that overshoot problems may still occur. However, this appears to be more a function of how hard the system is being pushed than how well the disclosed embodiments prevent the overshoot problem. For instance, any control scheme, except for the most over-dampened, may always lead to overshoot under extreme events. However, the disclosed embodiments have proven to strike a balance between minimizing overshoot problems while still allowing for responsive control.

Moreover, while the disclosed embodiments may be specifically suited for inter-stage attemperation of steam, they may also be used in other similar application such as food and liquor processing plants. Indeed, as discussed above, the disclosed embodiments may be utilized in many other scenarios other than the control of exhaust steam temperatures. For instance, the disclosed embodiments may be used in virtually any system where a fluid is to be heated, or cooled for that matter, using a heat transfer device. Whenever it may be important to control the outlet temperature of the fluid from the heat transfer device, the disclosed embodiments may utilize model-based predictive techniques to predict the outlet temperature based on inlet conditions into the heat transfer device. Then, using the predicted outlet temperature with the disclosed embodiments, attemperation of the inlet temperature into the heat transfer device may be performed to ensure that the actual outlet temperature from the heat transfer device stays within an acceptable range (e.g., below a set point temperature or above a saturation temperature). Furthermore, control of the model-based prediction and attemperation process may be performed using the feed-forward techniques as described above. Therefore, the disclosed embodiments may be applied to a wide range of applications where fluids may be heated or cooled by heat transfer devices.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A heat recovery steam generation system, comprising: at least one evaporator in a steam path configured to deliver steam to a steam turbine; at least one economizer coupled in series with the at least one evaporator in the steam path; a primary superheater and a finishing superheater, both in the steam path and configured to superheat steam from the at least one evaporator; an inter-stage attemperator in the steam path downstream of the primary superheater and upstream of the finishing superheater, wherein the inter-stage attemperator is configured to inject feedwater into the steam path; a control valve coupled to the inter-stage attemperator, wherein the control valve is configured to supply feedwater to the inter-stage attemperator for injection into the steam path; and a controller configured to control operation of the control valve and inter-stage attemperator, wherein the controller comprises a processor containing a feed-forward control using model-based predictive temperature control of a temperature of exhaust steam from the finishing superheater, and wherein the model-based predictive temperature control is configured to establish a profile for a set point steam temperature based on an inlet temperature of exhaust gas from a gas turbine such that the set point steam temperature may be reached only at or after the exhaust gas temperature reaches an isotherm.

2. The heat recovery steam generation system of claim 1, comprising a plurality of evaporators and a plurality of economizers, wherein the plurality of evaporators are configured to deliver steam to multiple stages of the steam turbine.

3. The heat recovery steam generation system of claim 2, wherein a low-pressure evaporator is configured to deliver steam to a low-pressure stage of the steam turbine, an intermediate-pressure evaporator is configured to deliver steam to an intermediate-pressure stage of the steam turbine, and a high-pressure evaporator is configured to deliver steam to a high-pressure stage of the steam turbine.

4. A controller, comprising:

a processor containing an outer control loop comprising a feed-forward controller configured to utilize a predicted value for an outlet temperature of steam from a finishing superheater, the feed-forward controller comprising a first input for receiving an inlet temperature of exhaust gas from a gas turbine and a second input for receiving a set point temperature for the outlet steam from the finishing superheater, wherein the outer control loop comprises a predictive model configured to predict the outlet temperature of steam based on the inlet temperature of exhaust gas from the gas turbine, the set point temperature for the outlet steam from the finishing superheater, and variables corresponding to inlet conditions into the finishing superheater, and wherein the predictive model is further configured to establish a profile for the set point temperature based on the inlet temperature of exhaust gas from the gas turbine such that the set point steam temperature may be reached only at or after the exhaust gas temperature reaches an isotherm; and an inner control loop comprising a first proportional-integral controller configured to control attemperation upstream of an inlet into the finishing superheater based on the predicted value.

5. The controller of claim 4, wherein the outer control loop comprises a second proportional-integral controller in parallel with the feed-forward controller, wherein the second proportional-integral controller is configured to compensate for inaccuracies of the predictive model.

6. The controller of claim 4, wherein the predictive model comprises a thermodynamic model.

7. The controller of claim 4, wherein the variables corresponding to inlet conditions comprise inlet temperatures, inlet pressures, inlet flow rates, specific heats, equivalent heat transfer coefficients, equivalent heat transfer areas, or a combination thereof.

8. The controller of claim 4, wherein attemperation is controlled by opening a control valve upstream of an inlet into the finishing superheater, and the control valve is configured to introduce feedwater into a path with the steam, and the feedwater is cooler than the steam.

9. The controller of claim 8, wherein the inner control loop comprises a linearization function block for operation of the control valve.

10. The controller of claim 4, wherein the inner control loop comprises controller logic configured to bypass attemperation if an inlet temperature of the steam into the finishing superheater is not greater than a saturation temperature of steam by a pre-determined safety value.

11. A controller for controlling exhaust steam temperatures from a finishing superheater, comprising: a processor containing model-based predictive temperature control logic configured to predict an exhaust steam temperature from a finishing superheater, wherein the model-based predictive temperature control logic is at least partially based on input variables comprising an inlet temperature of exhaust gas from a gas turbine into the finishing superheater and a set point temperature for the exhaust steam from the finishing superheater, and further wherein the model-based predictive temperature control logic is further configured to establish a profile for the set point temperature based on the inlet temperature of exhaust gas from the gas turbine such that the set point steam temperature may be reached only at or after the exhaust gas temperature reaches an isotherm; and attemperation control logic configured to control attemperation upstream of the finishing superheater with feed-forward control logic and the exhaust steam temperature predicted by the model-based predictive temperature control logic.

12. The controller of claim 11, comprising logic configured to bypass attemperation whenever an inlet temperature of steam into the finishing superheater does not exceed a saturation temperature of steam by a pre-determined safety value.

13. The controller of claim 11, wherein the model-based predictive temperature control logic further is at least partially based on an inlet pressure of steam or gas into the finishing superheater, an inlet flow rate of steam or gas into the finishing superheater, a steam specific heat, an equivalent heat transfer coefficient, an equivalent heat transfer area, or a combination thereof.

14. The controller of claim 11, wherein the model-based predictive temperature control logic comprises an empirical data-based model, a thermodynamic-based model, or a combination thereof.

15. The controller of claim 11, wherein the model-based predictive temperature control logic comprises a proportional-integral controller configured to compensate for inaccuracies in a predictive temperature model.

* * * * *